US006030183A

United States Patent [19]

Childress

[11] Patent Number: 6,030,183

[45] Date of Patent: Feb. 29, 2000

[54] VARIABLE MARGIN PRESSURE CONTROL

[75] Inventor: Dale B. Childress, Plainfield, Ill.

[73] Assignee: Caterpillar Inc., Peoria, Ill.

[21] Appl. No.: 09/070,296

[22] Filed: Apr. 30, 1998

[51] Int. Cl.[7] ..... F04B 49/08

[52] U.S. Cl. ..... 417/222.1

[58] Field of Search ..... 417/213, 222.1; 60/445, 452

[56] References Cited

U.S. PATENT DOCUMENTS

| | | | |
|---|---|---|---|
| 3,987,622 | 10/1976 | Johnson | 60/420 |
| 4,147,034 | 4/1979 | Johnson | 60/422 |
| 4,196,588 | 4/1980 | Johnson | 60/445 |
| 5,562,424 | 10/1996 | Manring | 417/222.1 |
| 5,567,123 | 10/1996 | Childress et al. | 417/222.1 |
| 5,839,885 | 11/1998 | Oda et al. | 417/222.1 |

*Primary Examiner*—Charles G. Freay
*Attorney, Agent, or Firm*—John W. Grant

[57] ABSTRACT

A variable margin pressure control for a variable displacement load sensing pump comprises a body having a bore therein and a valve spool slidably disposed in the bore defining a chamber in continuous communication with a discharge passage in the body. The valve spool is movable in a first direction for communicating the discharge passage with a control port in the body and in a second direction for communicating the control port with an exhaust flow path. The valve spool is biased in the first direction by discharge fluid pressure in the chamber. A spring mechanism biases the valve spool in the second direction against the force generated by the discharge pressure with a biasing force sufficient to establish a predetermined margin pressure. A remotely controllable variable biasing force is applied against the valve spool by a device so that the margin pressure can be selectively varied in response to receiving a pressure signal. Another devices applies a load pressure generated biasing force against the valve spool in the second direction so that the margin pressure is maintained throughout the pressure operating range of the pump.

7 Claims, 1 Drawing Sheet

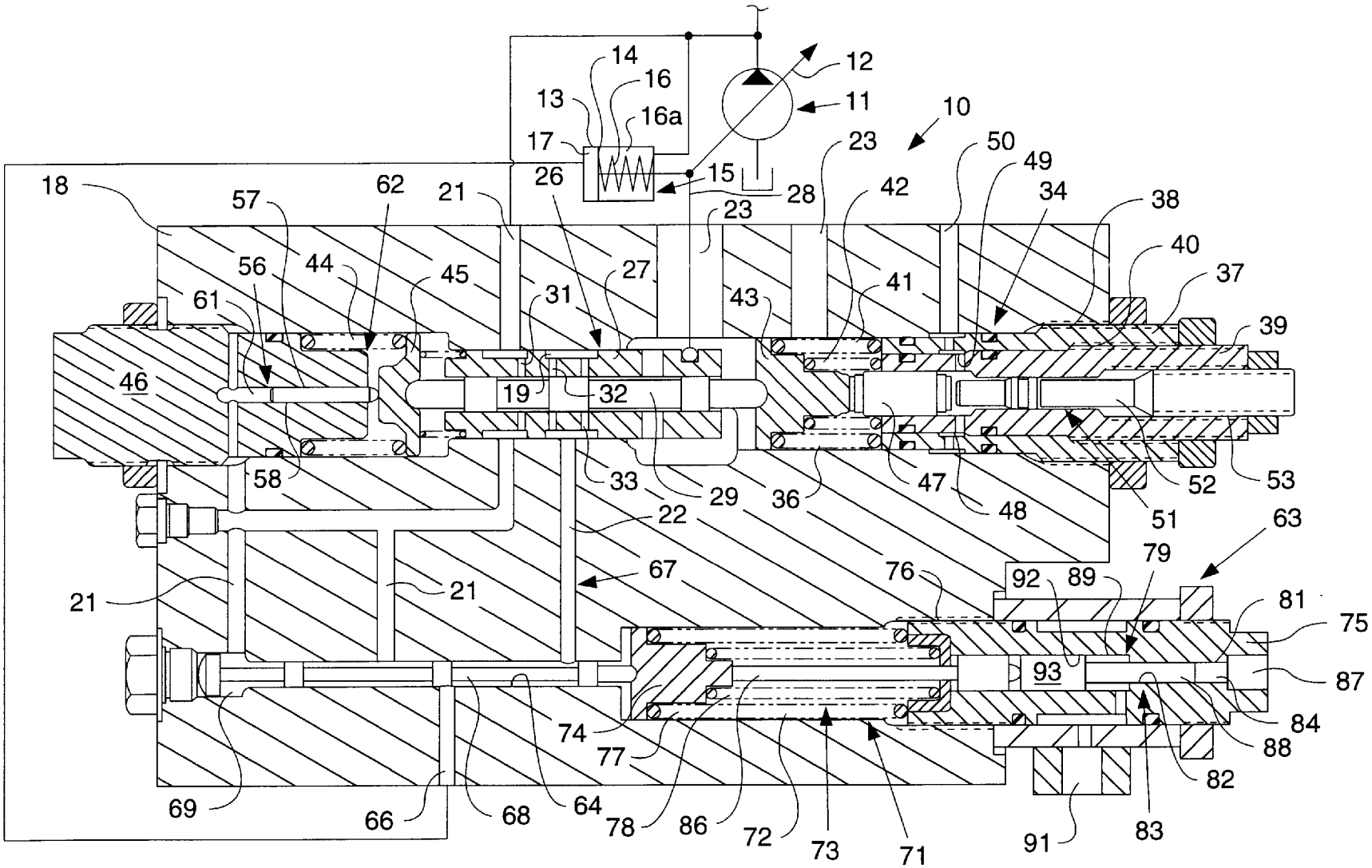
10
11
12
13
14
15
16
16a
17
18
19
21
22
23
26
27
28
29
31
32
33
34
36
37
38
39
40
41
42
43
44
45
46
47
48
49
50
51
52
53
56
57
58
61
62
63
64
66
67
68
69
71
72
73
74
75
76
77
78
79
81
82
83
84
86
87
88
89
91
92
93

VARIABLE MARGIN PRESSURE CONTROL

TECHNICAL FIELD

This invention relates generally to a variable displacement pump control and, more particularly, to a variable margin pressure control for a load sensing variable displacement pump.

BACKGROUND ART

The pump displacement controls for variable displacement hydraulic pumps used in closed center hydraulic systems typically have a load sensing or margin pressure control which maintains the pump discharge pressure at preset margin pressure. Margin pressure commonly refers to the pressure differential between the pump discharge pressure and the highest load pressure of the system during operation. In most closed center hydraulic systems, the margin pressure control also functions to maintain the pump discharge pressure at a value equal to the margin pressure when the system is not being used.

Some closed center hydraulic systems use a common pump for several separate hydraulic circuits. For example, the hydraulic system used on hydraulic excavators typically have separate circuits for controlling the boom, the stick and the bucket as well as the drive motors. A problem encountered therewith is that heretofore, the preset margin remains the same for all of the separate circuits. However, it has been found that operation of at least one of the hydraulic circuits can be enhanced in some operations if a higher margin pressure could be selectively made available to that one circuit. Thus it would be desirable to have a variable margin pressure control which maintains a predetermined margin pressure during most operations of the hydraulic system, but which could be selectively increased to a higher value when one of the hydraulic circuits is being operated.

The present invention is directed to overcoming one or more of the problems as set forth above.

DISCLOSURE OF THE INVENTION

In one aspect of the present invention, a variable margin pressure control for a variable displacement load sensing pump comprises a body having a bore therein, a discharge passage communicating discharge pressure to the bore, a control port communicating with the bore, and an exhaust flow path communicating with the bore. A valve spool slidably disposed in the bore defines a chamber in continuous communication with the discharge passage and is movable in a first direction for communicating the discharge passage with the control port and in a second direction for communicating the control port with the exhaust flow path. A device biases the valve spool in the second direction with a biasing force sufficient to establish a predetermined margin pressure. Another device applies a remotely controllable variable biasing force against the valve spool so that the margin pressure can be selectively varied in response to receiving a pressure signal. Another device applies a load pressure generated biasing force against the valve spool in the second direction so that the margin pressure is maintained throughout the pressure operating range of the pump.

BRIEF DESCRIPTION OF THE DRAWINGS

The sole drawing is a diagrammatic sectional view illustrating an embodiment of the present invention.

BEST MODE FOR CARRYING OUT THE INVENTION

Referring now to the drawings, a pump displacement control generally indicated by the reference numeral 10 is shown in combination with a variable displacement pump 11 having a swash plate 12 movable between maximum and minimum displacement positions. A servo actuator diagrammatically shown at 13 includes a servo piston 14 operatively connected to the swash plate 12, a means 15 for biasing the swash plate toward its maximum displacement position, and an actuator chamber 17 at one end of the piston for controllably receiving a control pressure to move the swash plate toward its minimum displacement position. The means 15 can be for example a compression spring 16 and a chamber 16a connected to pump discharge. While the pump displacement control and the servo actuator are shown separated from the variable displacement pump for illustrative convenience, these components are generally contained within or secured to the housing of the variable displacement pump.

The pump displacement control 10 includes a body 18 having a bore 19 therein, a discharge passage 21 communicating pump discharge pressure to the bore, a control passage 22 communicating the bore with the actuator chamber 17, and an exhaust passage 23 communicating with the bore.

A torque control valve 26 of the pump displacement control 10 is disposed within the bore 19 for controlling fluid flow into and out of the actuator chamber 17. The torque control valve includes a sleeve 27 slidably disposed within the bore 19 and a valve spool 29 slidably disposed within the sleeve. The sleeve is operatively mechanically coupled to the piston 14 through a connecting member 28 for moving the sleeve proportional to displacement of the swash plate. The valve spool and the sleeve are movable relative to each other to establish a first condition communicating the discharge passage 21 with the control passage 22 through annular ports 31,32 in the sleeve while blocking the control passage 22 from the exhaust passage 23 by blocking a pair of ports 33 in the sleeve. The valve spool and the sleeve also establish a second condition communicating the control passage 22 with the exhaust passage 23 through the ports 33 while blocking communication between the discharge passage 21 and the control passage 22 by blocking fluid flow through the ports 31,32. A neutral condition established by the valve spool and the sleeve blocks the discharge, control, and exhaust passages from each other.

A variable torque limiter 34 is disposed within an enlarged section 36 of the bore 19 in axial alignment with the torque control valve 26 for applying a remotely controllably variable resilient force biasing the valve spool 29 leftward in a first direction to establish the second condition. The torque limiter 34 includes a tubular spring force adjustment member 37 positioned within the enlarged section 36 and connected to the body 18 through a threaded connection 38. Another tubular spring force adjustment member 39 is co-axially disposed within the adjustment member 37 and is adjustably secured thereto through a threaded connection 40. A pair of coaxial compression springs 41,42 are disposed between the adjustment members 37,39 and a spring retainer 43 abutting the right end of the valve spool 29 to bias the valve spool 29 leftward. A spring 44 is disposed between a spring seat 45 abutting the left end of the valve spool 29 and a stop 46 to bias the valve spool leftward. A piston 47 is slidably disposed within a bore 48 of the adjustment member 39 defining a control chamber 49. The control chamber 49 continuously communicates with an inlet control port 50. The spring 42 functions as a bumper spring and cooperates with the spring 41 to approximate a constant torque curve.

A means 51 is provided for hydraulically stopping movement of the swash plate 12 toward the minimum displacement position and includes a minimum hydraulic flow stop 52 extending through and adjustably connected to the adjustment member 39 through a threaded connection 53.

A means 56 is provided for applying a force against the valve spool 29 proportional to the discharge pressure of the variable displacement pump so that the valve spool moves rightward in a second direction relatively to the sleeve 27 to establish the first condition when the control force exceeds the biasing force exerted by the torque limiter 34. The means 56 can include, for example, a piston or slug 57 slidably disposed within a bore 58 of the stop 46 defining a pressure chamber 61 continuously communicating with the discharge passage 21. The stop 46 is adjustably threadably secured within an open end of the bore 19, and as will hereinafter be described, serves as a means 62 for hydraulically stopping movement of the swash plate toward the maximum displacement position.

A variable margin pressure control mechanism 63 is included as part of the pump displacement control 10 and includes a bore 64 in the body 18, the discharge passage 21 for communicating discharge pressure to the bore 64, a control port 66 communicating the bore 64 with the actuator chamber 17, and an exhaust flow path 67 communicating with the bore 64. The exhaust flow path 67 includes the control passage 22, the radial ports 33 in the sleeve 27, and the exhaust passage 23. A valve spool 68 is slidably disposed in the bore 64 defining a chamber 69 in continuous communication with the discharge passage 21. At the leftward position shown, the valve spool 68 establishes communication between the control passage 22 and the control port 66 and blocks communication between the discharge port 21 and the control port 66. The valve spool 68 is movable rightward from the position shown for blocking communication between the control passage 22 and the control port 66 and communicating the discharge passage 21 with the control port 66. The valve spool 68 is biased rightward in a first direction by discharge fluid pressure in the chamber 69 and in a leftward direction by a means 71 for biasing the valve spool 68 leftward with a biasing force sufficient to establish a predetermined margin pressure.

The biasing means. 71 includes a spring chamber 72 at one end of the valve spool 68 and a spring mechanism 73 disposed in the spring chamber for resiliently biasing the valve spool in the leftward direction. The spring mechanism 73 includes a spring seat 74 abutting the end of the valve spool 68, a spring force adjusting member 75 adjustably secured to the body by a threaded connection 76 and a pair of coil compression springs 77,78 disposed between the spring seat 74 and the adjusting member 75.

The variable margin pressure control 63 also includes a means 79 for applying a remotely. controllable variable biasing force against the valve spool 68 so that the margin pressure can be selectively varied in response to receiving a pressure signal, and a means 81 for applying a load pressure generated biasing force against the valve spool 68 in the leftward direction so that the margin pressure is maintained throughout the pressure operating range of the pump.

The means 81 includes a bore 82 in the adjusting member 75, a piston arrangement 83 slidably disposed in the bore 82 defining a load pressure chamber 84 and having and end portion 86 abutting the spring seat 74, and a load pressure port 8,7 communicating with the load pressure chamber 84. The piston arrangement includes a piston 88 slidably disposed in the bore 82 and having an effective cross-sectional area equal to the cross-sectional area of the valve spool 68 defining the chamber 69.

The means 79 includes a control chamber 89 defined in part by the piston 88, and a control port 91 communicating with the control chamber 88. More specifically the control chamber 88 in this embodiment is an annular chamber formed between a counterbore 92 of the bore 82 and an enlarged portion 93 of the piston 88 slidably disposed in the counterbore.

Industrial Applicability

The pump displacement control 10 is commonly incorporated within a variable displacement pump 11 used with a closed center load sensing hydraulic system. The displacement of the pump 11 and thus the flow rate and discharge pressure is controlled by either the torque control valve 26 or the variable margin pressure control 71 dependant upon the pressure and/or flow rate demanded by the hydraulic system connected to the pump. If the pressure is below a predetermined high level for a given flow, displacement is essentially controlled by the margin pressure control 71. When the pressure exceeds the high predetermined level, the torque control valve 26 assumes control of the pump displacement.

The valve spool 29 and the sleeve 27 are shown at the neutral condition at which the actuator chamber 17 is blocked from both the discharge and exhaust passages 21 and 23. This is a default position established by the opposing forces of the springs 41 and 44 when no pressure is present in the control chamber 49 such as when the power source driving the pump is shut down. At this default position, the swash plate 12 moves-to a mid-displacement position.

In use, once the power source is started and a control pressure signal is directed into the control chamber 49, the piston 47 moves leftward biasing the valve spool 29 leftward to establish the second condition of the sleeve 27 and the valve spool for communicating the control passage 22 with the exhaust passage 23. Normally, this causes the swash plate to move toward the maximum displacement position. However, discharge pressure generated in the discharge port 21 by the pump starts to increase. When the discharge pressure reaches a predetermined low level, the discharge pressure in the chamber 69 moves the valve spool 68 rightward to communicate control pressure into the actuator chamber 17. This moves the swash plate toward the minimum displacement position against the bias of the spring 16. If no load pressure from the hydraulic system is present in the actuating chamber 84 and no pressure signal is being input to the control chamber 89, only the spring mechanism 73 resists rightward movement of the valve spool 68. A predetermined margin pressure is thus established by the preload of the springs 77,78 of the spring mechanism 73.

The predetermined margin pressure can be varied by selectively directing a pressure signal into the control chamber 89 through the control port 91 from a remote source. The pressure in the control chamber applies a biasing force onto the valve spool 68 urging it leftward against the discharge pressure generated force acting on the left end of the valve spool 68 so that the margin pressure is selectively varied to different level determined by the level of the pressure signal in the control chamber 89.

When a control valve, not shown, of the hydraulic system is thus opened for directing fluid to a hydraulic cylinder, one of two different actions normally takes place. If resistance to movement of the hydraulic cylinder is sufficiently low, the level of the discharge pressure in the discharge passage 21 and thus the control chamber 69 decreases. This allows the valve spool 68 to move leftward to communicate the actuator-chamber 17 with the exhaust pathway 67 permitting the spring 16 and discharge pressure in the spring chamber

16*a* to move the swash plate toward the maximum displacement position. Once the flow rate demanded by the system is satisfied, the valve spool 68 will move to a position to maintain the swash plate at a displacement setting as determined by the opposing forces acting on the spool 68.

Conversely, if an external force is resisting movement of the hydraulic cylinder so that a load pressure is generated and transmitted into the chamber 84, an additional load pressure induced force is exerted against the valve spool 68 biasing the valve spool 68 leftward against the force exerted on the valve spool 68 by the discharge pressure in the control chamber 74 so that the valve spool 68 communicates the actuator chamber 17 with the exhaust pathway 67 to increase pump displacement and thus the discharge pressure. Once the discharge pressure becomes greater than the load pressure by a value equal to the margin pressure, the opposing forces acting on the valve spool 68 equalize so that the swash plate is controlled to maintain the margin pressure.

Should the demand for fluid reach a level such that the discharge pressure exceeds the high predetermined level, the force exerted on the valve spool 29 by the discharge pressure in the control chamber 58 becomes sufficient to move the valve spool 29 rightward against the bias of the torque limiter 34 to establish the second condition of the valve spool and sleeve 22. This blocks communication between the control passage 22 and the exhaust passage 23 and communicates a control pressure through the control port 66 to the actuator chamber 17 causing the swash plate to move toward the minimum displacement setting for reducing the torque output of the pump. In extreme situations, rightward movement of the valve spool 29 will continue until the piston 47 contacts the minimum stop member 52 and the sleeve 22 reaches a position establishing the neutral condition blocking the discharge, control and exhaust passages from each other. This stops movement of the swash plate toward minimum displacement before it contacts the mechanical stop, not shown, and thereby hydraulically establishes the minimum displacement flow setting of the swash plate. The minimum displacement setting can be adjusted by axial adjustment of the stop member 52.

The predetermined high level at which the swash plate starts to move toward the minimum displacement setting can be varied by changing the level of the control fluid pressure in the control chamber 49 by any well known manner. Increasing the pressure in the control chamber 49 raises the predetermined high level while decreasing the pressure lowers the predetermined high level.

Other aspects, objects and advantages of this invention can be obtained from a study of the drawings, the disclosure and the appended claims.

I claim:

1. A variable margin pressure control for a variable displacement load sensing pump comprising:

a body having a bore therein, a discharge passage communicating discharge pressure to the bore, a control port communicating with the bore, and an exhaust flow path communicating with the bore;

a valve spool slidably disposed in the bore defining a chamber in continuous communication with the discharge passage, the valve spool being movable in a first direction for communicating the discharge passage with the control port and in a second direction for communicating the control port with the exhaust flow path, the valve spool being biased in the first direction by discharge fluid pressure in the chamber;

means for biasing the valve spool in the second direction with a biasing force sufficient to establish a predetermined margin pressure;

first means for applying a remotely controllable variable biasing force against the valve spool so that the margin pressure can be selectively varied in response to receiving a pressure signal; and second means for applying a load pressure generated biasing force against the valve spool in the second direction so that the margin pressure is maintained throughout the pressure operating range of the pump.

2. The variable margin pressure control of claim 1 wherein the biasing means includes a spring chamber at one end of the valve spool and a spring mechanism disposed within the spring chamber for resiliently biasing the valve spool in the second direction.

3. The variable margin pressure control of claim 2 wherein the spring mechanism includes a spring seat abutting the one end of the valve spool, a spring force adjusting member adjustably secured to the body and a spring disposed between the spring seat and the adjusting member, and the second means includes a bore defined in the adjusting member, a piston arrangement slidably disposed in the bore of the adjusting member defining a load pressure chamber and having an end in abutting the spring seat, and a load pressure port communicating with the load pressure chamber.

4. The variable margin pressure control of claim 3 wherein the valve spool has a cross sectional area and the load pressure chamber is defined in part by an effective area of the piston arrangement equal to the cross sectional area of the valve spool.

5. The variable margin pressure control of claim 4 wherein the first means includes a control chamber defined in part by the piston arrangement and a control port communicating with the control chamber.

6. The variable margin pressure control of claim 5 wherein the bore in the adjusting member has an enlarged portion and the piston arrangement includes a piston slidably disposed in the bore and having an enlarged portion slidably disposed in the enlarged bore portion, the control chamber being an annular chamber encircling the piston.

7. The variable margin pressure control of claim 6 wherein the pump includes a swash plate movable between maximum and minimum displacement positions and a servo actuator including a servo piston operatively connected to the swash plate, a means for biasing the swash plate toward its maximum displacement position, and an actuator chamber at one end of the piston for controllably receiving a control pressure to move the swash plate toward its minimum displacement position, the control port being in communication with the actuator chamber.

* * * * *